United States Patent [19]

Kelso

[11] 3,966,086

[45] June 29, 1976

[54] DISPENSER

[76] Inventor: Gordon W. Kelso, P.O. Box 3672, Austin, Tex. 78764

[22] Filed: May 27, 1975

[21] Appl. No.: 580,734

[52] U.S. Cl. ..... 221/234; 221/264; 221/269; 222/354

[51] Int. Cl.[2] ..... B65H 5/00

[58] Field of Search ..... 221/263, 264, 268, 269, 221/233, 234, 251; 222/354, 355, 361

[56] References Cited

UNITED STATES PATENTS

| | | | |
|---|---|---|---|
| 926,171 | 6/1909 | Cargill | 222/354 X |
| 1,843,233 | 2/1932 | Kaiser | 221/264 X |
| 2,852,167 | 9/1958 | Lempart | 222/354 |
| 3,201,008 | 8/1965 | Morena | 222/361 |

*Primary Examiner*—Allen N. Knowles
*Attorney, Agent, or Firm*—Laff, Whitesel & Rockman

[57] ABSTRACT

The dispenser has any suitable number of side-by-side bins, each with a sloping floor for guiding and directing pills toward an opening in the bottom of the bin. Mounted under each bin, a sliding drawer receives pills while the drawer is in a closed position and dispenses the pills while in an extended position. A display panel fits into the bin and supports a written statement behind a transparent bin front. Mounted on the bottom of the panel is a changeable pad which may be trimmed or otherwise shaped to enable passage of only a prescribed number of pills for a single dispensement. Any of various drawer types may be selected to accommodate different shapes, sizes, and forms of pills.

10 Claims, 8 Drawing Figures

DISPENSER

This invention relates to dispensers and more particularly to dispensers of small items and parts such as pills, nuts, bolts, and the like, hereinafter generically called "pills".

There always is a problem of selecting and dispensing one or a few small items, such as pills, especially when there are many different kinds or a varied schedule of usage. The problems are to segregate pills of different types, kinds, shapes, and sizes. Sometimes only one pill is required. Sometimes two or more pills are required for each dispensing operation. When more than the prescribed number of pills are dispensed simultaneously it should be simple and easy to return the excess number to the dispenser without danger of mixing different types.

When the small items are drugs, there are some very special and important problems. First, each pill must be taken on a prescribed schedule, which is generally different from the schedules prescribed for other types of pills. As the medication or dosage changes, the schedules are also likely to change. Therefore, there is need to provide a quick and easy way of posting, displaying, and changing the prescribed schedules. The display should be directly related to the physical objects to be dispensed, so that there are no problems of relating or mistaking the instructions, with respect to any particular drug. Another problem of that is that a dispenser for drugs must be "child-proofed" under some circumstances, so that very young children cannot obtain and swallow drugs which may be dangerous to their health. Still another problem is that pills come in many different sizes and shapes. Therefore, a dispenser for a prescribed number of one type of pills may not function with another type of pill.

Yet another consideration relates to costs. It would be easy to design a complex dispenser, of the described type, with many moving parts and a complicated work cycle. However, the cost of a practical dispenser should be so low that it is almost, if not in fact, a throw-away item. It is thought that a big demand for the inventive dispenser will be from original manufacturers and from drug stores which will use them in lieu of the ordinary plastic pill bottles used heretofore.

Medication does not usually last for extended periods of time; therefore, it should be possible to build the dispenser to be used only during the medication period, although a more durable design is also desirable. As medication changes, the user should be able to quickly and easily change the dispensing characteristics of the dispenser with little or no added cost and without requiring special skills or training.

Accordingly, an object of the invention is to provide new and improved dispensers of the described type for small items and parts, such as pills, nuts, bolts, and the like. In particular, an object is to provide such dispensers with means for automatically selecting and dispensing approximately the proper number of pills (regardless of size or shape) responsive to each operation. Here an object is to provide means for changing the number selected for each dispensing operation. Further, an object is to provide means for quickly and easily returning any surplus number of dispensed pills to the bulk storage within the dispenser.

Another object is to provide an easily child-proofed dispenser, if and when such child-proofing is either necessary or desirable.

Still another object is to provide a dispenser of the described type which is of such low cost that an original manufacturer or a druggist may package a prescription drug in it, almost as cheaply as in a conventional pill bottle.

In keeping with an aspect of this invention, these and other objects are accomplished by providing a plurality of side-by-side bins, preferably made of transparent material. Each bin has a sloping floor for guiding and directing the pills within the bin toward an opening in the bottom of the bin. Mounted under the floor of each bin is a sliding drawer mounted for movement between a closed and an extended position. An open top compartment is formed in the drawer for receiving the pills that pass from bulk storage within the bin and through the opening, while the drawer is in its closed position. Behind this compartment, the drawer has a horizontal panel, which closes the bin opening, when it is pulled to an extended position. A display panel fits into the bin and behind the transparent front to support a written statement that displays an identification or prescribed instructions. Mounted on the bottom and back of the panel is a pad which may be shaped to enble the simultaneous passage of only a prescribed number of pills while the drawer is closed. The front of the drawer is a trap door which tips open in a manner which dispenses one or more pills from the compartment. Any excess number of pills may be returned to the compartment before the drawer is closed.

The nature of a preferred embodiment of the inventive dispenser will become more apparent from the attached drawings wherein.

Figure 1:
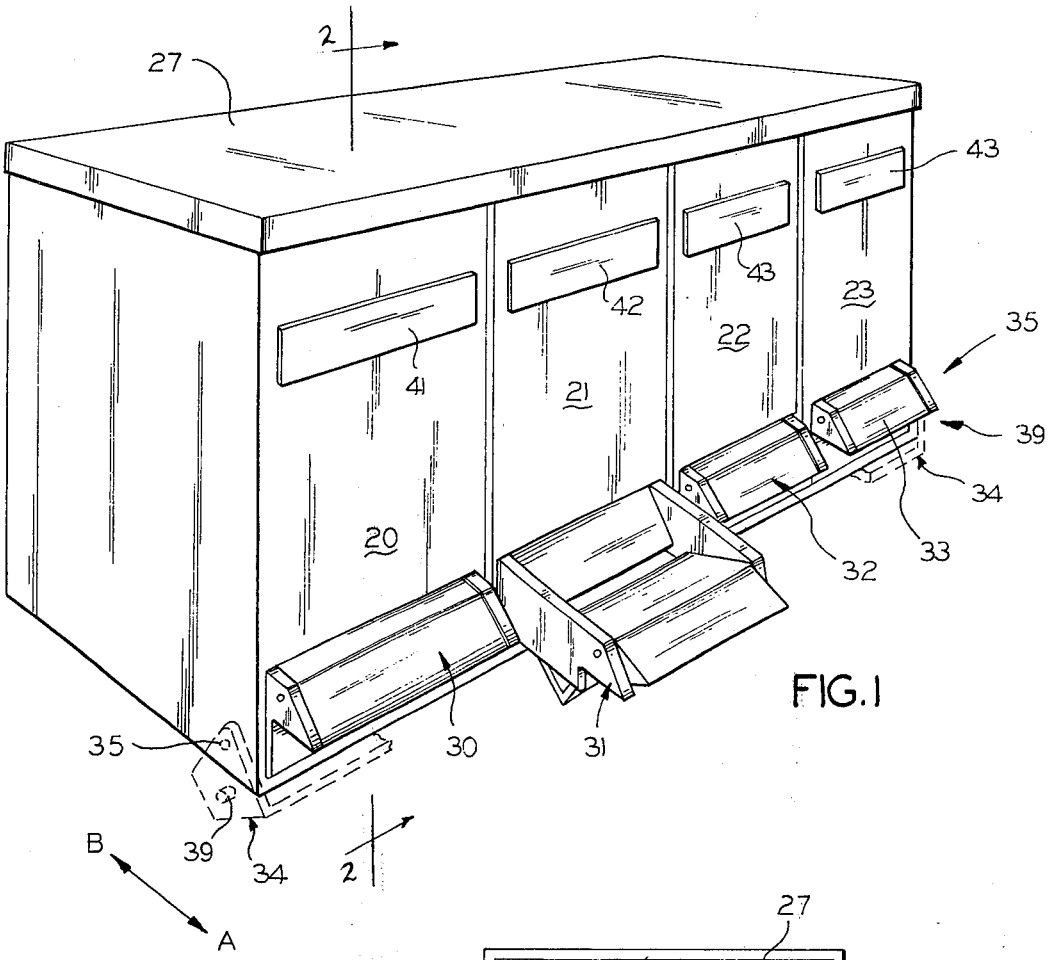
FIG. 1 is a perspective view of an exemplary four-bin dispenser incorporating the invention.

In FIG. 1, the invention is shown as comprising a dispenser housing having four side-by-side bins 20–23, manufactured as a single integrated unit. Each bin has a capacity which is adequate to store a bulk supply of a given type of pills. Any suitable number and size of bins may be provided. When an original manufacturer or drug store uses the invention as an original container for prescription drugs, it is thought that various size dispenser housings will be provided to accommodate 1, 2, 3, etc., different numbers of drugs.

The dispenser comprises a single, unitary, preferably transparent, housing (of any suitable plastic material, for example) having a sloping floor 24 (FIG. 2) terminated at the bottom in an opening 25. This way gravity causes pills 26 in the bin to fall through the opening into a compartment in the drawer beneath the opening. The top of the bins is closed by a single and unitary cover 27 which may either slip on or snap over the dispenser housing. When the bins are not to be refilled, a non-removable snap-on cover is preferred, so that small children cannot open it. If child proofing is not required, a simple friction-held cover may be used.

Beneath and individually associated with each of the bins 20–23 and included within the dispenser housing, are sliding drawers 30–33. These drawers are mounted to slide in direction A to an open drawer position (as at 31) or in direction B to a closed drawer position (as at 30). In the closed drawer position, the associated bin is effectively sealed, and no pills may be removed. When the drawer is in an open position, the pills may be removed therefrom.

Figure 2:
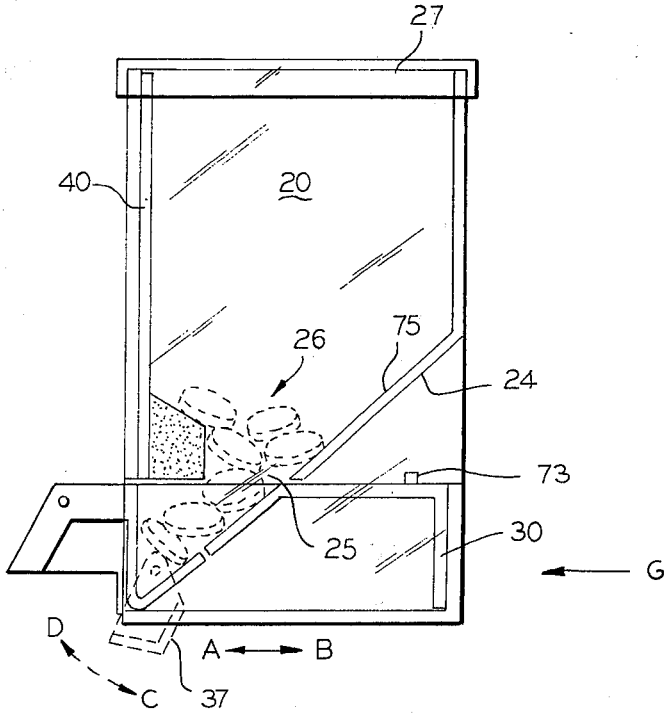
FIG. 2 is a side elevation view of the dispenser of FIG. 1 taken on line 2—2 thereof.

If there is a need to child-proof a box, a visor-like member 34 is pivotally mounted (as at 35) onto the dispenser housing. This visor comprises a bar 37 having an L-shaped cross-section, swings up in direction D or down in direction C. When visor 34 is swung down (as shown in FIGS. 1, 2), any one or more of the drawers may be opened. When raised, the visor 34 fits across the fronts of the drawers, interfers with, and locks them in the closed position so that they cannot be opened. Any suitable child-proof latch 39 may be mounted on each end of the visor 34, so that it cannot be swung down in direction C without an exercise of more skill than a small child possesses. For example, at opposite ends of the dispenser housing, the latches 39—39 may be made so that both must be simultaneously pushed and then slid in a given direction or directions while being so pushed. Other arrangements will readily occur to those who are skilled in the art. For example, a lid similar to 27 (or even a simple band) may snap on over the bottom of the dispenser housing, to hold the drawers in place.

Figure 3:
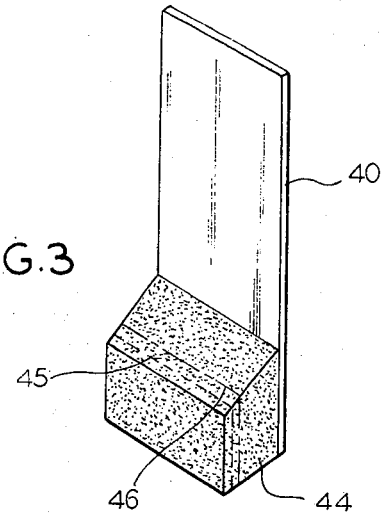
FIG. 3 is a perspective view of the back of a display panel having a pad attached to the bottom thereof.
Figure 4:
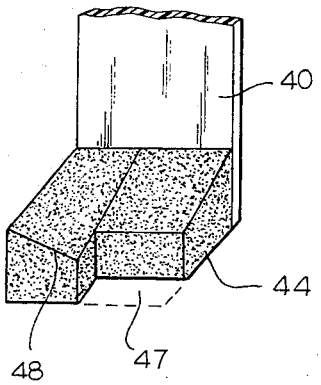
FIG. 4 is a fragmentary view of the panel of FIG. 3, illustrating another one of many ways in which the pad may be trimmed for dispensing a particular pill type.

Inside each bin 20–23, a display panel 40 (FIGS. 3, 4) may be held in place by a simple friction fit or by guideways molded into the plastic. This display panel may have any suitable information written thereon. For example, it could be a blank card on which the user writes any message suitable to himself. Or, when used as an original package by the manufacturer, the panel may include the usual manufacturer's label. When used by a druggist, a conventional typed prescription label may be glued to the panel. In any event, the panel will include any suitable identification and instructions, as symbolically indicated at 41–43 (FIG. 1).

On the back of each panel, a pad 44 is formed near the bottom and over the general area of the bin opening 25. This pad may be made of any suitable material, such as dense foam. As initially manufactured, the pad 44 is large enough to cover almost all of the bin opening 25 so that none except the smallest pills may fall therethrough. To fit the opening 25 to the size of the pill, the pad 44 is trimmed to provide an opening which is enlarged to the pill size. Thus, for example, to accommodate medium-size pills, a razor blade may be used to cut the pad along the dashed line 45. For larger pills, the pad may be cut along line 46 (or at any other desired place).

To further shape and size the opening, the pad may be cut in both longitudinal and crosswise directions to form a small width opening 47, which is large enough to pass one pill. The top of the pad may also be cut on a slant, as at 48, to guide and direct the pills toward the opening 47. This way, the bin may be arranged to feed any suitable number of pills into the associated drawer.

When a manufacturer uses the dispenser as original package, the pad 44 may be prefabricated in any suitable shape. Or, the panel 40 and pad 44 may be a single, unitary molded plastic piece part. When used by a druggist, he may, of course, cut the pad as a consumer or user would do. Or, more likely, he would stock a number of preformed panel and pad combinations and merely select the particular type of pad which fits the prescribed pill.

Figure 5:
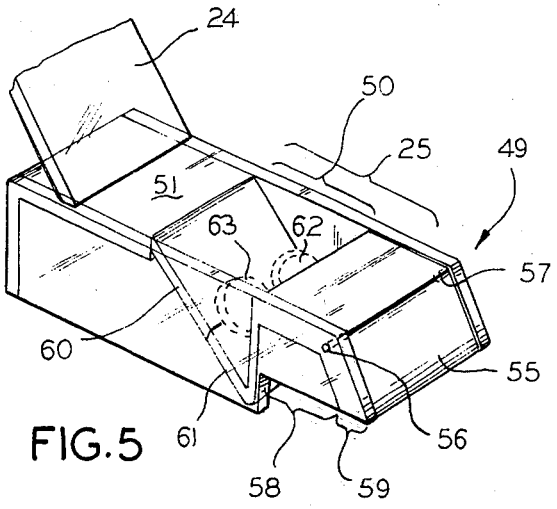
FIGS. 5 and 6 are two stop motion views showing one drawer construction, preferably for dispensing a relatively small pill.
Figure 6:
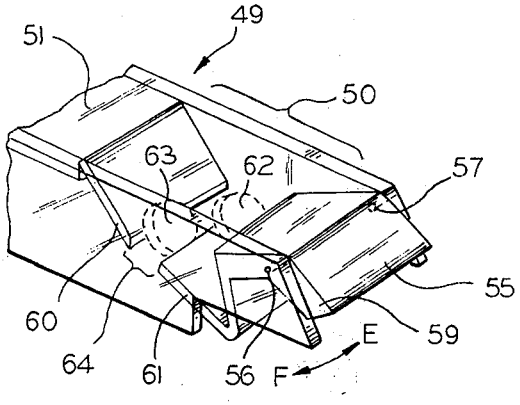

Each of the drawers 30–33 may also be made to serve a particular need. One such drawer type 49 (FIGS. 5, 6) comprises a compartment 50 mounted under the floor of the bin for receiving pills which fall through the opening 25, while the drawer is in a closed position (as at 30). On the drawer and in back of the compartment 50 is a horizontal solid top panel 51 which covers the opening 25 when the drawer 49 is pulled to an open or extended position (as at 31).

A trap door assembly 55 is pivotally mounted on the front of the drawer, at the pivot points 56, 57. Under the front of the trap door is a hole 58 having a size and shape which may receive the tip of a finger. The front panel of the hole 58 is closed by a bar 59 which may be caught by the finger tip, to manipulate the trap door. This way, the drawer may be pulled from or pushed into the dispenser housing.

Behind the finger hole 58 is a pill receiving section 50 which is closed at the rear in two separate panels 60, 61 running transversely across the drawer. Together, panels 60, 61 form an inclined plane extending from bin opening 25 to the bottom of the drawer. Panel 60 is integral with drawer 49, and panel 61 is integral with trap door 55. The panel 61 and the back and top of trap door 55 are somewhat Z-shaped in cross section. Any pills 62, 63 falling through bin opening 25 land on this inclined plane 60, 61, which guides and directs them toward the front end of the pill receiving compartment 50.

After the drawer is extended, an upward pressure (in direction E) on bar 59 tips the trap door 55 to open a space 64 between panels 60, 61. While the trap door so tips, the panel 61 is still in an upwardly inclined plane position which forms a pocket at the front of the Z-shape for receiving and holding a pill 62. As the opening 64 grows wider, one of the pills will almost certainly fall out of compartment 50 sooner than the other pills will fall. For example, FIG. 6 has been drawn so that pill 63 will almost certainly fall out first. If need be, the tipping may continue until the pocket formed, at the front of the Z-shape, by panel 61 is almost vertical to dispense everything contained therein. The tipping of trap door 55 can be done while the fingers are cupped below the drawer to receive the pill 63 which falls through the opening 64. With almost no skill or practice, it is easy to close the trap door 55 as soon as one pill 63 drops through the space 64 and before any other pill 62 can fall. However, there is no problem if two pills should drop at the same time. As soon as the trap door 55 is pivoted back in direction F to the closed position, the excess pills may be returned through the space 50 at the top of the drawer.

As long as the drawer 49 is open (as at 31), the panel 51 closes bin opening 25, so that no more pills may leave the bin. However, as soon as the drawer 49 is returned to the closed position (as at 30), drawer opening 50 is again aligned under the bin opening 25. Depending upon the number of pills already in the drawer compartment 50, a certain additional number of pills fall into the drawer, ready for the next dispensement.

Figure 7:
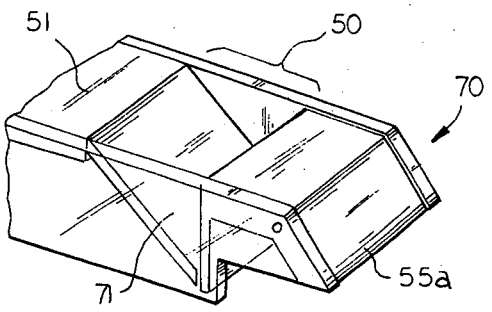
FIGS. 7 and 8 are two stop motion views showing a second drawer construction, preferably for dispensing relatively large pills.
Figure 8:
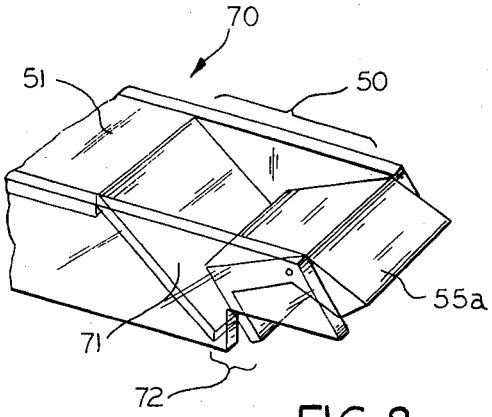

When the dispensed articles are large enough, the trap door panel 61 is not required to support the pills while the trap door 55 is open. In fact, for sufficiently large articles, the panel 61 may even be a hindrance which blocks easy passage through opening 64. Therefore, a second type of drawer 70 (FIGS. 7, 8) may be provided wherein the two panels 60, 61 may be combined into a single integral panel of any suitable shape. This way, the trap door 55a may open a larger space 72 which is not inhibited by the pocket formed on the trap door by panel 61.

The principle of providing separate drawer types to accommodate separate pill types may be expanded. For example, certain types of small items might require, say a "T" shaped opening 64 so that, say a bolt will tend to always drop out stem first. Also, as with the pad in FIG. 4, the width of the opening 64 may also be shaped to reduce or control the number of dispensed items. By a combination of canting or shaping the inclined plane 60 and reducing the width of the opening 64, it is possible to dispense even a single, very tiny pill. It should now be apparent that, a druggist, for example, may stock a number of different style pads 44 and drawers, so that almost any kind of small item may be dispensed at, say 1, 2, 3, . . . , small items per dispensement.

Returning to FIG. 2, it should now be apparent that any desired type of drawer may be inserted by pushing it into the back, in direction G. Any suitable detent 73 may be formed on the back of the drawer to abutt against and interfere with a portion 75 of the bin structure so that the drawer cannot be pulled out too far in the front of the dispenser housing. Also, any suitable detent may be provided to keep the drawer from being pushed back out of the dispenser housing once it has been snapped into place.

The principles of this invention may be expanded to accommodate any of many different variables. Therefore, the appended claims are to be construed to cover all equivalent structures falling within the true scope and spirit of the invention.

I claim:

1. A dispenser comprising at least one bin with a bottom opening and having a sloping floor for guiding and directing objects contained in the bin toward the bin opening, a sliding drawer individually associated with the bin and having a compartment beneath the bin opening for receiving pills stored in the bin, shapable means in the form of a pad superimposed over said bin opening, which pad may be shaped to at least partly cover said bin opening and to provide a hole with a reduced size as compared to the size of said bin opening for selectively enabling passage of approximately a predetermined number of said pills through said bin opening and into said compartment, whereby said hole reshapes said opening and does not necessarily have to have any predetermined minimum shape, size, or dimensions established by the shape, size or dimensions of said bin opening and movable trapdoor means associated with the compartment, said trapdoor being openable for enabling pills in the compartment to fall from said dispenser.

2. The dispenser of claim 1 and panel means on said drawer behind said compartment for closing said bin opening when said drawer is extended from said dispenser.

3. The dispenser of claim 1 wherein there are a plurality of said bins and individually associated drawers included within a single dispenser housing for selectively dispensing a plurality of different pills, whereby each of said different pills may have any size, shape and dimensions and said holes may be custom fitted to such size, shape and dimensions.

4. The dispenser of claim 1 wherein said bin comprises a housing having at least a transparent panel and display panel means for mounting behind said transparent panel to display information relative to pills stored inside the bin, said shapable means comprising said pad attached to the back of said display panel when said display panel is in place, and said shapable means being dense foam located over said opening and shaped to cooperate with said sloping floor to form and reshape said bin opening into said hole.

5. The dispenser of claim 1 and lockable visor means fitting over and preventing an opening of said drawer for child-proofing said dispenser.

6. A dispenser comprising at least one bin with a bottom opening and having a sloping floor for guiding and directing objects contained in the bin toward the bin opening, a sliding drawer individually associated with the bin and having a compartment beneath the bin opening for receiving pills stored in the bin, shapable means at least partly covering said bin opening for selectively enabling passage of approximately a predetermined number of said pills through said bin opening and into said compartment, movable trapdoor means associated with the compartment, said trapdoor being openable for enabling pills in the compartment to fall from said dispenser, wherein said trap door has a somewhat Z-shape, is mounted on a pivot to tip to an open position, a part of the Z-shape forming a pocket to receive and hold a pill as the trap door begins to tip whereby any pill trapped in the pocket tends to be retained within the trap door while any other pill which is not so trapped tends to fall from said compartment, said tipping continuing if need be until said pocket is inverted.

7. The dispenser of claim 6 wherein a first panel on said drawer and a second panel forming one section of said Z-shape cooperate to form a single inclined plane for directing pills falling through said opening into said pocket.

8. The dispenser of claim 1 wherein there are a plurality of said bins and individually associated drawers included within a single transparent dispenser housing for selectively dispensing a plurality of different types of pills, each of said pill types being individually stored in a corresponding one of said bins, and display panel means for mounting behind a transparent panel in each of said bins for displaying information relative to the type of pills stored inside the corresponding bin.

9. The dispenser of claim 8 wherein each of said display panels has said shapable means formed on the back thereof, each of said shapable means comprising a pad of dense foam located to cooperate with said sloping floor in order to form and reshape said bin opening.

10. A dispenser comprising a plurality of bins, each of said bins having a bottom opening and a sloping floor for guiding and directing objects contained in the bin toward the bin opening, a sliding drawer individually associated with each of the bins and having a compartment beneath the associated bin opening for receiving pills stored in the associated bin, said plurality of bins and their individually associated drawers being included within a single transparent dispenser housing for selectively dispensing a plurality of different types of pills, each of said pill types being individually stored in a corresponding one of said bins, display panel means for mounting behind a transparent panel in each of said bins for displaying information relative to the type of pills stored inside the corresponding bin, shapable means at least partly and individually covering each of said bin openings for selectively enabling passage of approximately a predetermined number of said pills through said bin openings and into said compartment of the individually associated drawer, each of said display panels having said shapable means formed on the back thereof, each of said shapable means comprising a pad of dense foam located to cooperate with said sloping floor in order to form said bin opening into a hole of selected size, movable trapdoor means in each of said drawers and associated with the compartment, said trapdoor being openable for enabling pills in the compartment to fall from said dispenser, wherein said trap door is pivotedly attached to the front of said drawer to tip and dispense pills in said compartment, said trap door having a somewhat Z-shaped cross-section, with part of the Z-shape representing panels forming a pocket to retain a pill throughout part but not all of a cycle as the trap door tips, whereby any pill trapped in the pocket tends to be retained within the trap door while any other pill which is not so trapped tends to fall from said compartment, said tipping cycle continuing if need be until said pocket is inverted to dispense the trapped pill, a pair of panels, one of said panel pairs being integral with said drawer and the other of said pair of panels being integral with said trap door and being the part of said Z-shape which forms said panel, said pair of panels cooperating to form an inclined plane for directing pills falling through said opening into said pocket.

* * * * *